US005377968A

United States Patent [19]

Sobotta et al.

[11] Patent Number: 5,377,968

[45] Date of Patent: Jan. 3, 1995

[54] FEEDER OF A PAPER SHEET PROCESSING MACHINE

[75] Inventors: Peter Sobotta, Heidelberg; Isolde Maxeiner, Östringen, both of Germany

[73] Assignee: Heidelberger Druckmaschinen AG, Heidelberg, Germany

[21] Appl. No.: 165,982

[22] Filed: Dec. 13, 1993

[30] Foreign Application Priority Data

Dec. 11, 1992 [DE] Germany ..... 4241788

[51] Int. Cl.[5] ..... B65H 3/08

[52] U.S. Cl. ..... 271/11; 271/103

[58] Field of Search ..... 271/90, 91, 92, 93, 271/103, 11-13

[56] References Cited

U.S. PATENT DOCUMENTS 4,869,489 9/1989 Wirz ..... 271/103 X
5,064,184 11/1991 Liepert ..... 271/14
5,253,858 10/1993 Grieve ..... 271/103

FOREIGN PATENT DOCUMENTS 3410963 10/1985 Germany .
3644201 7/1988 Germany .
293562 9/1991 Germany .

*Primary Examiner*—Richard A. Schacher
*Attorney, Agent, or Firm*—Herbert L. Lerner; Laurence A. Greenberg

[57] ABSTRACT

A feeder in a paper sheet processing machine has a plurality of lifting suckers for lifting a paper sheet from a stack of paper sheets. After the sheet is lifted into a raised position it is entrained by a transport device and transported to a paper sheet processing unit. A force potential acts permanently on the lifting sucker downwardly in a direction towards the stack. The lifting sucker is lifted against the force potential in a cyclically controlled manner in a lifting and lowering stroke. A retaining collar is formed on the lifting sucker beneath which a retaining support engages so as to delay a return of the lifting sucker to its lower position and to stop the sucker in the lower position. The retaining support is mounted shiftably parallel to the stroke direction of the lifting sucker. Controlled pneumatics communicate with the retaining structure, so as to shift the same as a function of the stroke position of the lifting sucker.

7 Claims, 4 Drawing Sheets

FEEDER OF A PAPER SHEET PROCESSING MACHINE

BACKGROUND OF THE INVENTION

FIELD OF THE INVENTION

The invention relates to a feeder of a paper sheet processing machine, such as a printing unit of a printing machine.

Deliveries of paper sheet processing machines have been heretofore known in which a paper sheet is taken from the stack and lifted up with the aid of lifting suckers. The sheet is then transferred to further transport means disposed downstream, as seen in a sheet transport direction, which deliver the paper sheet into paper processing units, for instance a printing unit of a printing machine. It is thereby important that the lifting suckers remain in the raised position until the rear edge (trailing edge) of the sheet has been removed from the stroke region of the lifting sucker. The lifting suckers are subsequently quickly lowered for picking up the next paper sheet.

Mechanical locking devices are known with which the lifting sucker is retained above the paper sheet and moved downwards after the retainer is released. Such mechanically intricate arresting systems are too sluggish, particularly for quick-moving machines. The establishment, and primarily the release, of the lock requires a very long time, so that the next paper sheet can only be lifted up belatedly, which substantially impairs the operational speed, for example the printing speed. When the arrest is released earlier, the lifting sucker may touch the trailing edge of the paper sheet which may damage the same or the paper sheets may be torn away from the following transport means or at least shifted in their position. This is particularly critical if the following transport devices are entraining suckers.

A proposed solution for simple, brief stopping of lifting suckers is known from German Patent DD PS 293 562 A5, corresponding to U.S. Pat. No. 5,064,184 to Liepert. The lifting sucker is thereby retained in the upper position by means of suction air via an additional suction line in the suction head which acts from above on a flat contact surface of the lifting sucker. After the rear edge of the paper sheet taken over by the entraining suckers leaves the stroke region of the lifting sucker, the suction air is interrupted in the additional suction line. The lifting sucker can be lowered for accepting the next paper sheet in a conventional manner. Due to the additional suction line disposed in the close vicinity of the lifting sucker and to the suction control, the proposed lifting sucker is very expensive and complicated. The retaining surface is shaped as a nose, so that a rotation of the sucker, as it is often required during operation, is not possible without limitations to the quickly reacting holding mechanism. Also, the pneumatic forces must be adjusted very accurately to the weight of the lifting sucker.

SUMMARY OF THE INVENTION

It is accordingly an object of the invention to provide a feeder of a paper sheet processing machine, which overcomes the hereinafore-mentioned disadvantages of the heretofore-known devices of this general type and which simple in construction, yet provides for quick-release of its entraining effect and which provides for favorable reaction times during operation.

With the foregoing and other objects in view there is provided, in accordance with the invention, a feeder in a paper sheet processing machine, comprising:

- a lifting sucker for lifting a paper sheet from a stack of paper sheets;
- transport means operatively associated with the lifting sucker for entraining the lifted paper sheet and for transporting the paper sheet from a lifted position above the stack to a paper sheet processing unit;
- force potential means permanently acting on the lifting sucker downwardly in a direction towards the stack;
- means connected at the lifting sucker for lifting the lifting sucker against the force potential in a cyclically controlled manner;
- a retaining collar formed on the lifting sucker;
- retaining means mounted shiftably parallel to a stroke direction of the lifting sucker, the retaining means including a support permanently disposed below the retaining collar in a stroke area of the retaining collar; and
- controlled pneumatic means communicating with the retaining means for shifting the retaining means in dependence of a stroke motion of the lifting sucker.

The lifting sucker is subject to a continuous, for sheet pickup downwardly effective, force potential. This continuously effective force potential makes a quick-reaction lowering of the lifting sucker possible after the lifting sucker has been released by the retaining means. In its raised position, the lifting sucker can be retained by means of the support, which is also pneumatically controlled independently of the lifting sucker. The mechanical retaining means are raised parallel to the stroke of the lifting sucker, and they retain the same in the upper position against the force of the force potential accelerating the lifting sucker downwardly. Due to the pneumatically driven lowering of the retaining means parallel to the stroke of the lifting sucker, a quick, immediate release of the retention of the lifting sucker is possible. The pneumatically controllable means for shifting the retaining means allow quick-reaction raising and lowering of the mechanical retaining means and thus a quick establishment and release of the retaining force. It is thus possible to provide a quick-reaction retaining mechanism for the lifting sucker in its raised position with simple means.

The pneumatic forces need not, as is the case with the above-mentioned teaching of Liepert due to the pneumatic retaining force excentrically to the lifting sucker axis and directly acting on the lifting sucker provided therein, be adjusted in their magnitude as finely and accurately to the lifting sucker weight. The pneumatic control can be made simpler. Necessary lines can be provided even farther outside the direct stroke area of the lifting sucker. Any errant air which disturbs the sheet transport is avoided.

In accordance with an added feature of the invention, the feeder includes a pneumatic cylinder disposed adjacent to the lifting sucker, and a pneumatically controlled lifting piston disposed in the pneumatic cylinder being shiftable parallel to a stroke direction of the lifting sucker, the support being mounted on the lifting piston.

In accordance with an additional feature of the invention, the support is a pin oriented perpendicularly relative to the stroke direction of the lifting sucker.

In accordance with another feature of the invention, the feeder includes means for guiding the support parallel to the stroke direction of the lifting sucker. The guiding means are preferably attached at the lifting sucker.

These foregoing features provide for particularly advantageous, inexpensive and dependable embodiments of the invention. The utilization of the pneumatic cylinder provides for a particularly secure, quick-reacting retaining device. The embodiment of the support as a pin or latch provides for a simple and inexpensive, yet dependable, retaining means. The pin is guided with guide means for improving the functional dependability and the reaction dependability.

In accordance with a further feature of the invention, the feeder includes means associated with the pneumatic cylinder for allowing the pneumatic cylinder to be pivoted about an axis perpendicular to the stroke direction of the lifting sucker into a position away from a retaining position and back into the retaining position.

In accordance with a concomitant feature of the invention, the feeder includes means for guiding the support parallel to the stroke direction of the lifting sucker, and wherein the means for guiding the support parallel to the stroke direction are pivotable together with the pneumatic cylinder away from an operating position and back into the operating position.

The latter two features provide for embodiments of the invention which allow the quick exchange of the lifting sucker. The pivoting away of the retaining means allows the lifting sucker with its retaining collar to be pulled downwardly past the retaining means, so that it can be exchanged against another one. This proves advantageous also in the use of a retaining collar of the lifting sucker with a profiled cross section, for instance a square cross section for the individual adjustment of the lifting nozzle lips.

The feeder according to the broad invention described herein, makes it further possible to do without other retaining means which limit the lifting stroke, as for instance retaining springs. Such mechanical devices cause the lifting and lowering action to become sluggish. The support which permanently reaches into the lifting stroke path of the retaining collar of the lifting sucker (unless it is pivoted away during the above-described exchange) limits the stroke path downwardly in that the retaining collar of the lifting sucker stops at the support when the support is lowered in the lower position of the lifting sucker.

Other features which are considered as characteristic for the invention are set forth in the appended claims.

Although the invention is illustrated and described herein as embodied in a feeder of a paper sheet processing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIGS. 3*a* and 3*b* are similar sectional views of the lifting sucker device taken along the line III—III of FIG. 1, wherein FIG. 3*a* illustrates the lifting sucker device with a lowered lifting sucker and FIG. 3*b* illustrates the lifting sucker device with a raised lifting sucker and a retaining device;

DESCRIPTION OF THE PREFERRED EMBODIMENTS

Figure 1:
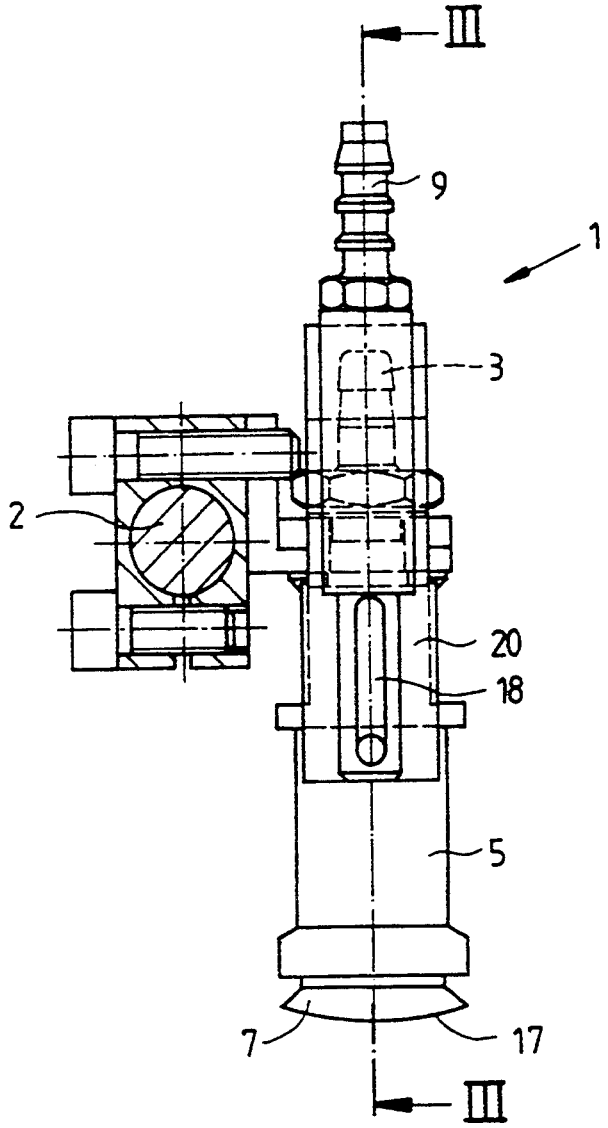
FIG. 1 is a side-elevational view of a lifting sucker unit.
Figure 2:
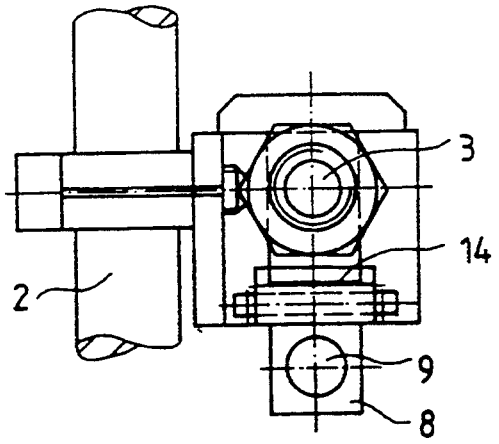
FIG. 2 is a top-plan view of an exemplary lifting sucker unit of a suction head of a sheet-fed printing press.

Referring now to the figures of the drawing in detail and first, particularly, to FIGS. 1 and 2 thereof, there is seen a lifting sucker unit 1. A plurality of lifting suckers are mounted in a conventional manner at a transverse bar 2 which extends transversely to the sheet transport direction of a sheet-fed printing machine above a feeder stack. The transverse bar 2 is mounted in a suction head.

The lifting sucker units 1, of which one is illustrated for clarity, are provided with a conventional guide cylinder 4 attached at the transverse bar 2. A lifting sucker 5 is mounted on the guide cylinder 4 and it is downwardly shiftable in a direction towards the feeder stack. A suction stub 3 of the guide cylinder 4 is subjected to vacuum (suction air) in a conventional manner for lifting the lifting sucker 5. A cylinder space 15 defined in the lifting sucker 5 and nozzles 6 are also subject to vacuum, which is established in a conventional manner through a bore formed in the guide cylinder 4. After the paper sheet is aspirated by the nozzles 6, the lifting sucker 5 is raised against the effect of a spring 16, so that a portion of the energy expended in lifting the sucker 5 is stored as potential energy in the spring 16. With reference to the illustration of FIG. 3, the lifting sucker 5 is raised from its position shown in FIG. 3*a* into an upper position shown in FIG. 3*b*. In the upper position, the spring 16 stores its maximum force potential.

At an upper edge thereof the lifting sucker 5 is provided with a stop shoulder or retaining collar 13 formed over the entire circumference of the lifting sucker 5. The lifting stroke of the sucker is upwardly defined by stopping the retaining collar 13.

A mounting plate 20 is articulated at the lifting sucker device via a pin 12 which is mounted in a plane perpendicular to the longitudinal axis of the lifting sucker. The longitudinal axis of the sucker 5 defines a stroke direction of the lifting sucker. A pneumatic cylinder 8 with a pneumatic piston 11 axially shiftable therein is attached to the mounting plate 20. The pneumatic cylinder 8 communicates via a pneumatic line 9 with a non-illustrated, controlled pneumatic source of known contruction. A piston 11 slides in the cylinder 8. A pin 10 is attached at the pneumatic piston 11 and it extends perpendicularly to the stroke of the pneumatic piston 11. The pin 10 protrudes through an oblong hole 18 formed in the mounting plate 20 and oriented parallel to the stroke direction of the pneumatic cylinder 11. The retaining pin 10, with its end facing away from the pneumatic cylinder 11, points towards the axis of the lifting sucker 5.

A spring 14 pushes the mounting plate 20 against a stop surface 19 mounted on the transverse bar 2 and oriented perpendicularly to the stroke direction of the lifting sucker, so that the stroke of the pneumatic piston 11 is parallel to the stroke of the lifting sucker 5. The end of the pin 10 facing away from the pneumatic piston 11 thereby engages permanently beneath the retaining collar 13 into the area of reach of the retaining collar 13.

As soon as the lifting sucker has been raised into its upper position, the pneumatic cylinder 8 is subjected to a vacuum with suction air at the connector 9. The guide pin 10 thereby drives from its lower position (FIG. 3*a*) into its upper position (FIG. 3*b*), at which it comes into retaining contact with the lower stop surface of the retaining collar 13. As soon as the lifted paper sheet is removed in its entirety from the effective area of the lifting sucker by the entraining suckers transporting the sheet downstream as seen in a direction of sheet travel, the pneumatic circuit for the pneumatic cylinder 8 is ventilated and the retaining force of the pin 10 is immediately disengaged. The lifting sucker 5, which has already been previously ventilated for releasing the paper sheets, falls downward due to its own weight. This motion is amplified by the spring force of the spring 16, so that the lifting sucker reaches the lower position more quickly in which it is ready to receive the next paper sheet. The also downwardly falling pneumatic piston 11 and the guide pin 10 are thereby safely entrained in the downward motion.

For the purpose of accelerating the release and relieving the lifting sucker movement from having to entrain the pneumatic piston 11, it is also possible to accelerate the pneumatic piston 11 downwardly by subjecting it to an overpressure through the pneumatic line 9. It is further possible to accelerate the piston downwardly with a non-illustrated spring. The guide pin 10, in its lower position, can act as a limit stop for the lifting sucker 5.

It is, of course, also possible to provide additional limit means for downwardly limiting the stroke of the lifting sucker 5, for instance with a non-illustrated limit spring disposed above the lower position of the retaining pin 10. The lifting sucker stroke will then be stopped at its retaining collar 13.

Figure 3A:
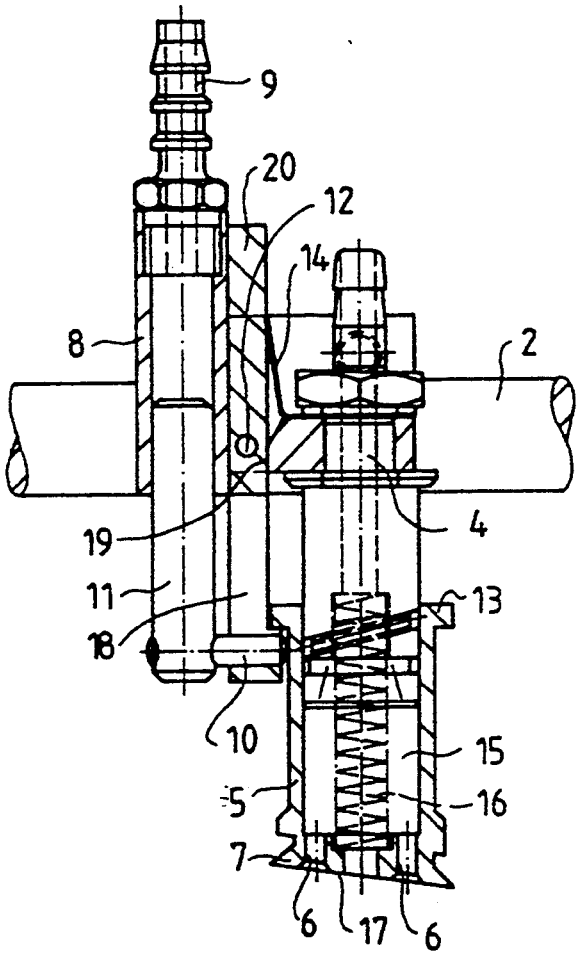
Figure 3B:
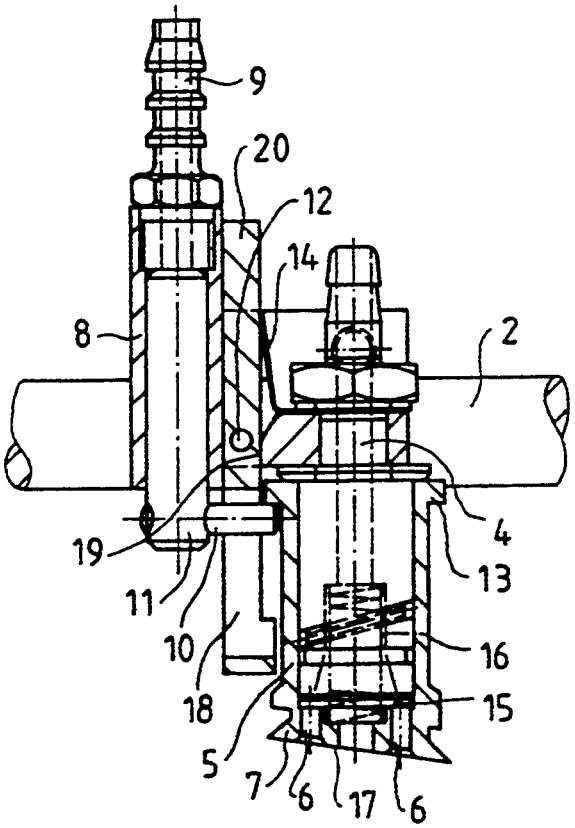
Figure 4:
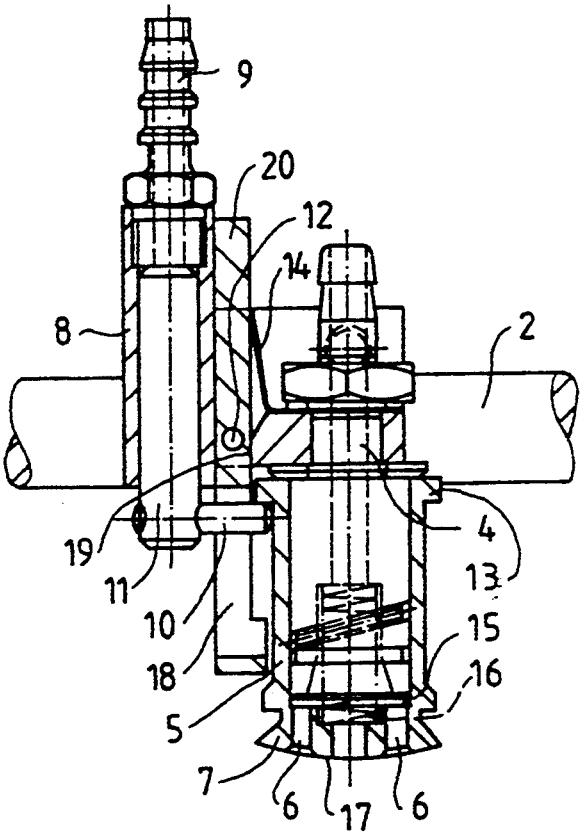
FIG. 4 is a view similar to FIG. 3*a* with a rotated lifting sucker.

As illustrated in FIGS. 3*a*, 3*b* and 4, the lifting sucker 5 can be rotated about its longitudinal axis, i.e. the stroke axis. This is often advantageous in response to certain operating requirements with suckers having a receiving plane 17 of a lip 7 which is not oriented perpendicular to the stroke axis. As shown in FIG. 4, a secure and quick-reaction retention can be ensured as well in the case of a rotated receiving plane.

For the purpose of exchanging the lifting sucker, the pneumatic cylinder 8, together with the mounting plate 20, is pivoted about a pin 12, counter to the biasing force of the spring 14. Consequently, the guide pin 10 leaves the region underneath the retaining collar 13. At that point, the lifting sucker 5 can be pulled downwardly off the guide cylinder 4, with its retaining collar 13 freely passing by the guide pin 10.

For the purpose of a simplified adjustment of certain preselected lifting sucker adjustment positions, it is provided that the retaining collar 13 of the lifting sucker 5 is formed with a given profile, for instance a square profile concentrical to the lifting sucker axis, instead of a circular profile. In that case, a respective one of the four sides of the square face towards the mounting plate 20. In the case of a square retaining collar 13, therefore, the receiving plane 17 may be rotated into four different angular orientations (while not altering its oblique relationship with the stroke axis of the sucker 5). For adjusting the receiving plane 17, the pneumatic cylinder 8 with the mounting plate 20 and the guide pin 10 are also pivoted from the area of movement of the retaining collar 13, so that the lifting sucker can be rotated about is axis until the desired side of the four-side profile faces the mounting plate 20. After the rotation of the lifting sucker, the mounting plate 20 is pivoted back into its mounting position due to its spring force. Instead of the four preselectable adjustment positions of the receiving plane 17, it is, of course, also possible to provide the retaining collar 13 with a hexagonal or octagonal profile instead of the four sides, so that six or eight or, in the case of yet another profile, several rest surfaces and thus adjustment angles of the receiving plane are possible. It is seen that the rotational orientation of each of the plurality of suckers in the suction head is individually adjustable.

Figure 5:
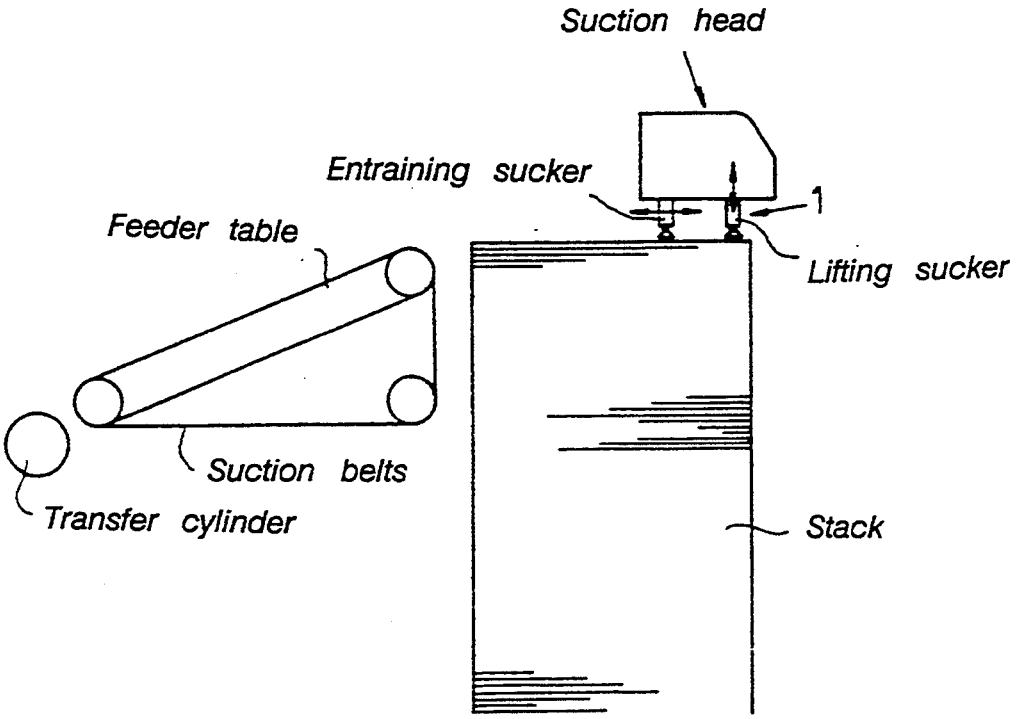
FIG. 5 is a diagrammatic illustration of the paper sheet delivery environment in which the lifting sucker according to the invention is employed.

With reference to FIG. 5, a suction head is illustrated above a paper stack. The suction head supports lifting suckers 1 and entraining suckers. After a sheet is lifted up from the paper stack, the entraining suckers deliver the same to the feeder table where, via suction belts and the like, it is supplied to a transfer cylinder. The transfer cylinder, in turn, transfers the sheet to the paper sheet processing unit, such as a printing unit of a printing machine.

We claim:

1. A feeder in a paper sheet processing machine, comprising:

a lifting sucker for lifting a paper sheet from a stack of paper sheets;

transport means operatively associated with said lifting sucker for entraining the lifted paper sheet and for transporting the paper sheet from a lifted position above the stack to a paper sheet processing unit;

force potential means permanently acting on said lifting sucker downwardly in a direction towards the stack;

means connected at said lifting sucker for lifting said lifting sucker against said force potential in a cyclically controlled manner;

a retaining collar formed on said lifting sucker;

retaining means mounted shiftably parallel to a stroke direction of said lifting sucker, said retaining means including a support permanently disposed below said retaining collar in a stroke area of said retaining collar; and controlled pneumatic means communicating with said retaining means for shifting said retaining means in dependence of a stroke motion of said lifting sucker.

2. The feeder according to claim 1, including a pneumatic cylinder disposed adjacent to said lifting sucker, and a pneumatically controlled lifting piston disposed in said pneumatic cylinder being shiftable parallel to a stroke direction of said lifting sucker, said support being mounted on said lifting piston.

3. The feeder according to claim 2, wherein said support is a pin oriented perpendicularly relative to the stroke direction of said lifting sucker.

4. The feeder according to claim 2, including means for guiding said support parallel to the stroke direction of said lifting sucker.

5. The feeder according to claim 4, wherein said means for guiding said support are attached at said lifting sucker.

6. The feeder according to claim 2, including means associated with said pneumatic cylinder for allowing said pneumatic cylinder to be pivoted about an axis perpendicular to the stroke direction of said lifting sucker into a position away from a retaining position and back into the retaining position.

7. The feeder according to claim 6, including means for guiding said support parallel to the stroke direction of said lifting sucker, and wherein said means for guiding said support parallel to the stroke direction are pivotable together with said pneumatic cylinder away from an operating position and back into the operating position.

* * * * *